United States Patent [19]

Rivetta et al.

[11] 3,953,102

[45] Apr. 27, 1976

[54] TERMINAL CLIP FOR MICROMODULE

[75] Inventors: Gianfranco Rivetta; Guido Castracani, both of Milan, Italy

[73] Assignee: Societa Italiana Telecommunicazioni Siemens S.p.A., Milan, Italy

[22] Filed: Sept. 16, 1974

[21] Appl. No.: 506,111

[30] Foreign Application Priority Data

Sept. 18, 1973 Italy ..... 29041

[52] U.S. Cl. ..... 339/258 R; 174/68.5; 339/17 LC; 339/275 R

[51] Int. Cl.[2] ..... H01R 13/12

[58] Field of Search ..... 339/17, 75 MP, 176 MF, 339/176 MP, 258, 275; 174/68.5

[56] References Cited

UNITED STATES PATENTS

| | | | |
|---|---|---|---|
| 2,911,609 | 11/1959 | Burtt et al. | 339/176 MP |
| 3,748,633 | 7/1973 | Lundergan | 339/258 R |

FOREIGN PATENTS OR APPLICATIONS

| | | | |
|---|---|---|---|
| 88,889 | 2/1967 | France | 339/17 LC |
| 1,528,076 | 4/1968 | France | 339/17 LC |
| 1,280,703 | 11/1961 | France | 339/17 L |
| 1,439,586 | 4/1966 | France | 339/176 MP |

*Primary Examiner*—Joseph H. McGlynn
*Attorney, Agent, or Firm*—Karl F. Ross; Herbert Dubno

[57] ABSTRACT

A conductive sheet-metal clip, to be soldered onto a chip of integrated circuitry, has two prongs interconnected at a base which forms a seat for an edge of the chip fitted between these prongs, one prong being rigid while the other is weakened near the base so as to be resiliently deformable in the plane of the clip. One prong has a pair of projections engaging the chip at two points, near its free end and near the base, whereas the other prong has a projection bearing upon the chip at a point about midway between the first two points. A terminal tab extends from the base in the region of the rigid prong.

5 Claims, 4 Drawing Figures

TERMINAL CLIP FOR MICROMODULE

FIELD OF THE INVENTION

Our present invention relates to a terminal clip to be soldered onto a flat body of dielectric material having a conductive coating on at least one surface, such as a chip of integrated circuitry comprising a ceramic substrate which bears a conductive pattern in the form of an adhering metallic film.

BACKGROUND OF THE INVENTION

Microcircuit modules of this description, especially with so-called thick conductive layers, are usually disposed on printed-circuit plates whose conductive network must be linked with the pattern of the chip through suitable terminals engaging the chip both mechanically and galvanically. To satisfy the requirements for a firm mechanical attachment and good electrical contact, it has heretofore been the practice to encase the chip along with a set of associated tongues, stamped from a metallic strip, in a hardenable plastic mass forming a block from which the ends of the tongues project laterally, after hardening of the mass, for completing the external connections. The uncoated side of the chip is flush with the bottom of the plastic block and is therefore exposed, this bottom side being placed on the printed-circuit carrier or base which must be provided with holes or recesses for terminal pins to be soldered to these tongues.

This conventional technique has the drawback that the tongues must be soldered to the chip conductors prior to encasement, with the result that these soldered connections may be detrimentally affected by the hot plastic material subsequently cast therearound. Also, precise alignment of the tongue positions with the locations of the terminal pins in the base is necessary. Furthermore, if a chip is also provided with a conductive coating on all or part of its underside, a conductive connection to that underside from any of the terminals cannot be conveniently made. Thus, the procedure just described is suitable mainly for mass-produced circuit components but is not very practical for the manufacture of individual units or small series.

OBJECTS OF THE INVENTION

The general object of our invention, therefore, is to provide an improved terminal connection for microcircuit modules or the like with avoidance of the aforestated drawbacks and without the need for encasement in a plastic mass.

A more particular object is to provide a terminal clip which can be attached to a chip or similar body at whatever location is desired and which obstructs only a small part of the chip surface so that a large number of such clips can be accommodated thereon side by side.

SUMMARY OF THE INVENTION

These objects are realized, in conformity with our present invention, by the provision of a terminal clip in the form of a sheet-metal member having a base and two prongs integrally projecting therefrom, the base and one prong being relatively nondeformable (at least in the plane of the member) whereas the other prong is resiliently deformable with reference to the base. The two prongs define with each other an insertion slot for the chip or other conductor-supporting body to be engaged, this body being then gripped by the two prongs between two spaced-apart projections on one prong and a third projection, about midway between the other two, on the other prong. Such a three-point engagement insures firm contact between the clip and the engaged body even before the soldering of a conductor on that body to one of the engaging prongs; if desired, both prongs could be soldered to respective conductors on opposite body surfaces.

For the purpose of completing a connection between the conductor or conductors of the body and an external circuit, a tab extends integrally from this clip in the region of the nondeformable prong. This location of the tab insures that deformation of the other prong upon insertion of the body will have no significant effect upon the position of the connecting tab. By the same token, one or more additional external leads can be fastened to the clip at or near the nondeformable prong, e.g. at the free end thereof.

BRIEF DESCRIPTION OF THE DRAWING

The above and other features of our invention will now be described in detail with reference to the accompanying drawing in which.

SPECIFIC DESCRIPTION

Figure 1:
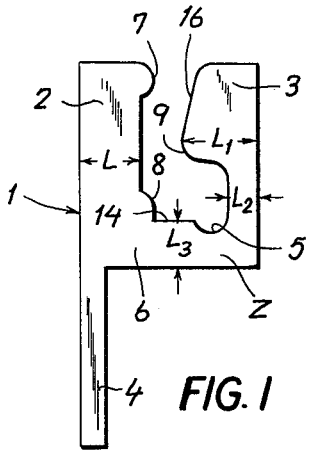
FIG. 1 is a face view of a terminal clip embodying our invention.
Figure 2:
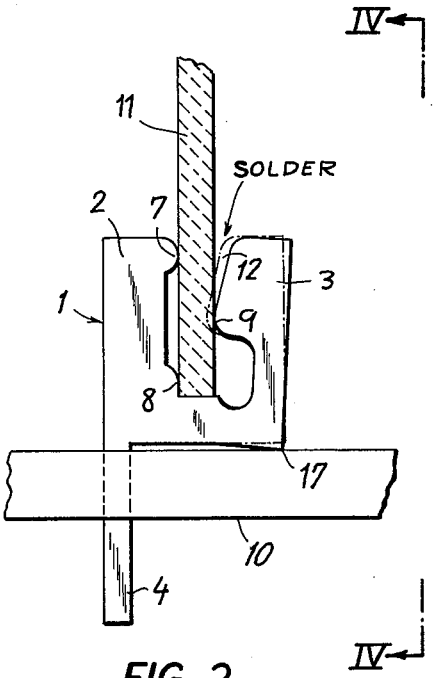
FIG. 2 is a view similar to FIG. 1, showing a microcircuit chip inserted into the clip.
Figure 4:
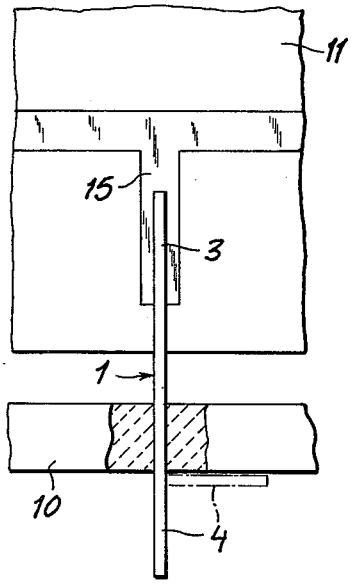
FIG. 4 is a lateral view taken on the line IV — IV of FIG. 2.

A clip member 1 of sheet metal, shown in FIGS. 1, 2 and 4, has two prongs 2, 3 rising from a base 6 and defining between them a slot for the insertion of a flat body 11 such as a microcircuit chip. A connecting tab 4 extends integrally from base 6 in the region of the prong 2 which has a substantially constant width L sufficient to make it substantially nondeformable, in the plane of the clip, by the stresses arising from the insertion of the chip 11. This chip comes to rest on a seat 14 formed by the base 6 near its junction with prong 2, the width $L_3$ of the base at that seat being approximately equal to the width L of the prong.

Prong 2 is formed with two projections or bosses facing the prong 3, i.e. a first boss 7 at the free end of prong 2 and a second boss 8 near the base 6. The other prong 3 has a projection 9, facing the prong 2, substantially midway between the levels of bosses 7 and 8, the prong 3 having its greatest width $L_1$ (slightly exceeding the width L of prong 2) at that projection whereas a section thereof extending from projection 9 to base 6 is of substantially reduced width $L_2$, e.g. about half the width L. The junction of base 6 with prong 3 is recessed at 5 to form a weakened region Z which enables the prong 3 to flex resiliently outwardly, as seen in FIG. 2, when the chip 11 is inserted. Upon such insertion the chip is engaged at three points, by projections 7, 8 and 9, so located as to provide a maximum gripping effect.

The two bosses 7 and 8 are tangent to a straight imaginary line, perpendicular to seat 14, whose position does not shift upon insertion of chip 11 since only the prong 3 is displaced by the chip. This prong has an edge 16, extending outwardly from boss 9, which diverges from that straight line by a small angle and thus forms a gap 12 open toward the free end of prong 3. This gap can be used as a convenient receptacle for solder serving to bond the prong 3 to a conductor strip 15 (FIG. 4) aligned therewith on the confronting face of chip 11. It should also be noted that the resulting sawtooth shape of boss 9 helps secure the chip 11 in its insertion slot even before the soldering operation. Diverging edge 16 also forms a convenient inlet for the guidance of chip 11 into its engaged position.

If the opposite chip surface is also conductively coated, a connection between aligned conductors on the two sides of the chip can be established by the clip 1 whose prong 2 is then likewise soldered to a conductor confronting it, advantageously at the boss 7.

FIGS. 2 and 4 show the tab 4 inserted into a slot of a ceramic plate 10 on which the clip 1 comes to rest at 17 and which carries a nonillustrated printed-circuit pattern on its underside. The extremity of tab 4 projecting beyond the slot of plate 10 can then be bent over (as indicated in phantom lines in FIG. 4) and soldered onto a conductor of that circuit.

Figure 3:
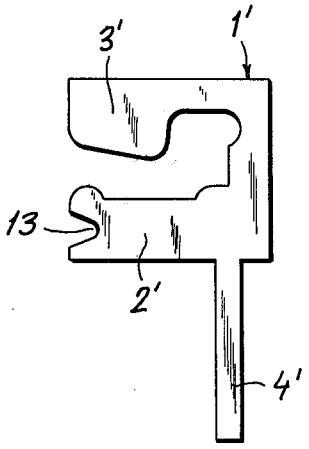
FIG. 3 is a view similar to FIG. 1, illustrating a modification.

FIG. 3 shows a similar clip 1' whose prongs 2' and 3' have substantially the same shape as their counterparts in FIGS. 1 and 2, a tab 4' extending here at right angles to the insertion slot (i.e. to the straight line defined by bosses 7 and 8) rather than parallel thereto as in the preceding embodiment. Again, this tab is not subject to any dislocation upon introduction of the chip 11 between the prongs.

FIG. 3 also shows an incision 13, at the free end of prong 2', for the anchorage of an external conductor to be soldered thereto. This conductor, too, will be unaffected by the presence or absence of a chip 11 between the prongs.

We claim:

1. A terminal clip to be soldered onto a flat body of dielectric material with a conductive coating on at least one surface, comprising a sheet-metal member forming a base, a first prong and a second prong integral with one another, said base and said first prong being relatively nondeformable, said second prong being resiliently deformable with reference to said base in the plane of said member and defining with said first prong an insertion slot for said body, said first prong being provided with a first projection at its free end and with a second projection at said base, said first and second projections facing said second prong to bear upon a surface of the inserted body, said second prong being provided with a third projection facing said first prong between said first and second projections to bear upon another surface of the inserted body, said first and second projections being tangent to an imaginary line spaced from said third projection, said base having an edge transverse to said imaginary line forming a seat for said body between said second projection and said second prong, said member further having a connecting tab extending outwardly from the region of said first prong.

2. A terminal clip as defined in claim 1 wherein said other prong has a sloping edge extending from said third projection to the free end thereof and diverging from said imaginary line.

3. A terminal clip as defined in claim 1 wherein said first prong is provided near its free end with an incision to accommodate an external lead.

4. A terminal clip as defined in claim 1 wherein said base is provided adjacent said second prong with a recess facing said insertion slot, said seat terminating at said recess.

5. A terminal clip as defined in claim 4 wherein said second prong has a reduced section extending from said recess to the vicinity of said third projection, said reduced section having a width substantially less than that of said first prong.

* * * * *